US010556187B2

(12) United States Patent
Horikoshi et al.

(10) Patent No.: US 10,556,187 B2
(45) Date of Patent: Feb. 11, 2020

(54) TOY TOP

(71) Applicant: TOMY COMPANY, LTD., Tokyo (JP)

(72) Inventors: Kenji Horikoshi, Tokyo (JP); Takeaki Maeda, Tokyo (JP)

(73) Assignee: TOMY COMPANY, LTD., Tokyo (JP)

( * ) Notice: Subject to any disclaimer, the term of this patent is extended or adjusted under 35 U.S.C. 154(b) by 38 days.

(21) Appl. No.: 15/991,137

(22) Filed: May 29, 2018

(65) Prior Publication Data

US 2018/0339236 A1 Nov. 29, 2018

(30) Foreign Application Priority Data

May 29, 2017 (JP) ..... 2017-105442

(51) Int. Cl.
*A63H 1/04* (2006.01)
*A63H 1/00* (2019.01)
*A63F 9/16* (2006.01)

(52) U.S. Cl.
CPC ..... *A63H 1/04* (2013.01); *A63H 1/00* (2013.01); *A63F 9/16* (2013.01)

(58) Field of Classification Search
CPC ... A63H 1/04; A63H 1/02; A63H 1/00; A63H 29/20; A63H 33/26; A63F 9/16
USPC ..... 446/4, 256, 257, 263
See application file for complete search history.

(56) References Cited

U.S. PATENT DOCUMENTS 9,101,845 B2 * 8/2015 Cai ..... A63H 1/18
9,566,529 B1 * 2/2017 Shindo ..... A63H 1/02
10,183,226 B2 * 1/2019 Muraki ..... A63H 1/02
2014/0302743 A1 * 10/2014 Cai ..... A63H 1/18 446/256
2016/0325190 A1 * 11/2016 Muraki ..... A63H 1/02

FOREIGN PATENT DOCUMENTS

EP 2 380 642 A1 10/2011
JP 3083443 U 1/2002
JP 2006-55333 3/2006
JP 3170034 U 9/2011
WO 2016/157544 A1 10/2016

OTHER PUBLICATIONS

Patent Abstracts of Japan English Abstract for Japanese Patent Publication No. 2006-55333, dated Mar. 2, 2006.
Extended European Search Report dated Oct. 31, 2018 in corresponding European Patent Application No. 18173914.5.
Office Action for Japanese Patent Application No. 2017-105442, dated Mar. 13, 2018.

* cited by examiner

*Primary Examiner* — Nini F Legesse
(74) *Attorney, Agent, or Firm* — Staas & Halsey LLP

(57) ABSTRACT

A toy top includes a shaft portion and a body that includes a first body part which is rotatable relative to the shaft portion in response to an impact applied to the main component and a second body part which is rotatable relative to the first body part. First spaced extensions extend radially outward from a circumference of the first body. Second spaced extensions extend radially outward from a circumference of the second body. The second extensions stepwise vary their positions relative to the first extensions when the first body part rotates relative to the shaft portion. The second extensions move into the spaces between the first extensions when the first body part rotates relative to the second body part.

20 Claims, 9 Drawing Sheets

TOY TOP

BACKGROUND OF THE INVENTION

1. Field of the Invention

The present invention relates to a toy top.

2 Description of Related Art

A battle game using toy tops that has been known in the art involves forcing toy tops to collide with each other so that a resultant impact force stops the spinning of an opponent toy top or knocks out or disassembles the opponent toy top.

Some of such toy tops are designed to include offensive strength and defensive strength that are changeable. For example, an attachment with a bump is attached to a toy body, and the bump has such a shape that allows changing the offensive or defensive strength (e.g. Japanese Utility Model No. 3083443).

The attachment disclosed in Japanese Utility Model No. 3083443 is designed to impart different offensive strength and defensive strength according to whether the attachment is attached in the face-up or face-down position, so that the offensive strength and the defensive strength are changeable by reversing the attachment. However, the offensive strength and the defensive strength of such a toy top can only be changed by removing the attachment from the toy body, turning over the attachment, and remounting the attachment to the toy body.

SUMMARY OF THE INVENTION

An object of the present invention, which has been conceived in view of the above-described issue, is to provide a toy top having offensive strength that varies according to attacks received from an opponent toy top.

According to an aspect of the present invention, a toy top includes:

a shaft portion; and a body including a main component which is rotatable relative to the shaft portion in response to an impact applied to the main component, wherein the body has a first body part which constitutes the main component, a second body part which is rotatable relative to the main component, first spaced extensions that extend radially outward from a circumference of the first body part, second spaced extensions that extend radially outward from a circumference of the second body part, wherein the second extensions stepwise vary their positions relative to the first extensions when the main component rotates relative to the shaft portion, and wherein the second extensions move into the spaces between the first extensions, respectively, when the first body part rotates relative to the second body part.

In this configuration, the second extensions vary the positions relative to the first extensions every time the main component rotates relative to the shaft portion. The defensive or offensive strength varies accordingly. In this case, the collision with an opponent toy top causes the main component to rotate stepwise relative to the shaft portion. The toy top maintains the offensive and defensive strength according to the rotational position during a battle game. Such a battle game full of changes can entertain players.

For example, in the case that the second extensions are ejected from and moved behind the first extensions, the body has large depressions in the circumference in the state of the second extensions that are not ejected from the first extensions. When the second extensions are ejected from the first extensions, the body has a near-circular shape because at least a portion of the depressions in the circumference is filled with the second extensions. The toy top can thereby parry the attack of the opponent toy top. This enhances the defensive strength while reducing the offensive strength. Conversely, when the second extensions are moved behind the first extensions, the body has large depressions in the circumference. Thus, the corners of the first extensions of the body are likely to collide with the opponent toy top. This enhances the offensive strength while reducing the defensive strength. Since the state of the depressions in the circumference of the body varies also in other cases, the offensive and defensive strength vary.

During decoupling of the shaft portion from the body, the second extensions are ejected such that the body has a near-circular shape in the circumference. Meanwhile, the defensive strength is enhanced while the offensive strength is reduced. The stability in the rotation of the toy top is thereby enhanced.

Preferably, the second body part vertically overlaps with the first body part and rotates together with the shaft portion.

In this configuration, the second body part just rotates together with the shaft portion, which achieves a simple structure to allow the second body part to engage with the shaft portion.

Preferably, the second body part engages with the shaft portion through the intermediary of a flywheel rotatable together with the shaft portion.

Since the second body part engages with the shaft portion through the intermediary of a flywheel, the motion of the second extensions is enhanced.

Preferably, the shaft portion is coupled with the body when the main component rotates in a first direction relative to the shaft portion, and the shaft portion is decoupled from the body when the main component rotates in a second direction.

In this configuration, decoupling of the shaft portion from the body varies the offensive and defensive strength, which gives the toy top or the opponent toy top chances for the tide turning and provide exciting and entertaining battle games.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DESCRIPTION OF THE EMBODIMENTS

A toy top according to embodiments of the present invention will now be described with reference to the accompanying drawings. Though various technical limitations which are preferable to perform the present invention are included in the after-mentioned embodiments, the scope of the invention is not limited to the following embodiments and the illustrated examples.

Overall Configuration

Figure 1:
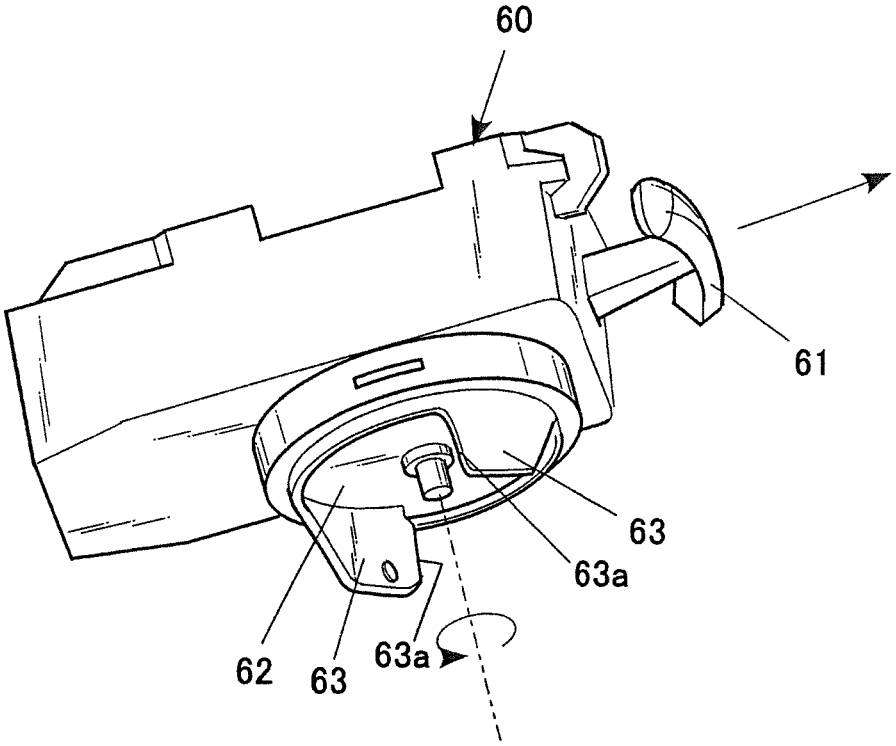
FIG. 1 is a perspective view of a toy top and a launcher (toy-top launching device) according to an embodiment.
Figure 1:
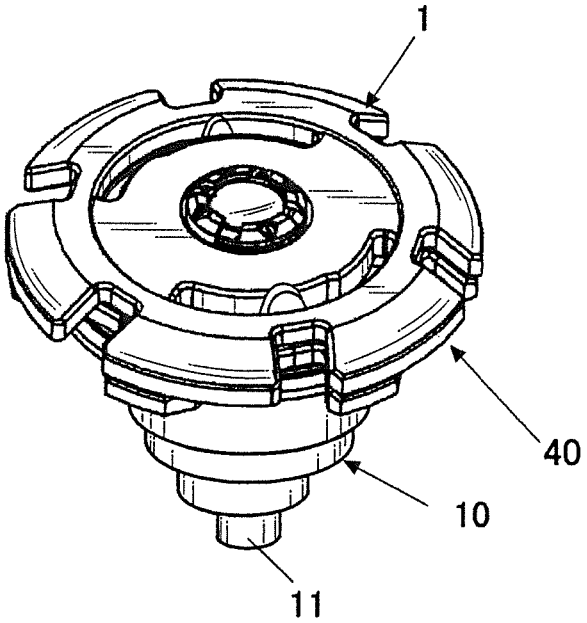

FIG. 1 illustrates a toy set including a toy top 1 and a toy-top launcher 60 according to the first embodiment.

Figure 2:
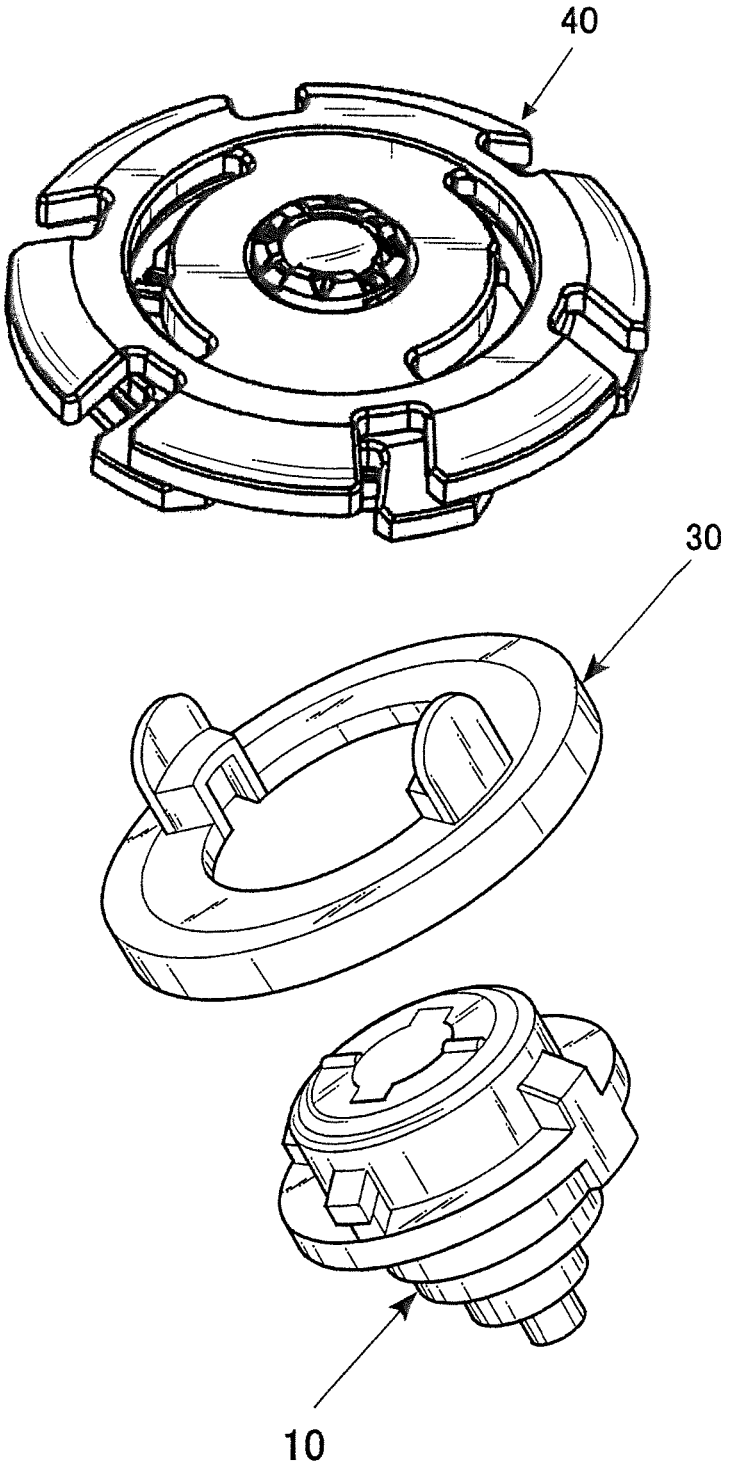
FIG. 2 is a perspective view of the toy top in action according to the embodiment.

The toy top 1 is of a type that can be used in a so-called "top battle game." The toy top 1, for example, can be used in a battle game in which a player wins the game when an opponent toy top 1 is disassembled as illustrated in FIG. 2 by the impact force of a collision between toy tops.

With reference to FIG. 2, the toy top 1 is composed of a shaft portion 10, a flywheel 30, and a body 40.

Details

1. Shaft Portion 10

Figure 3:
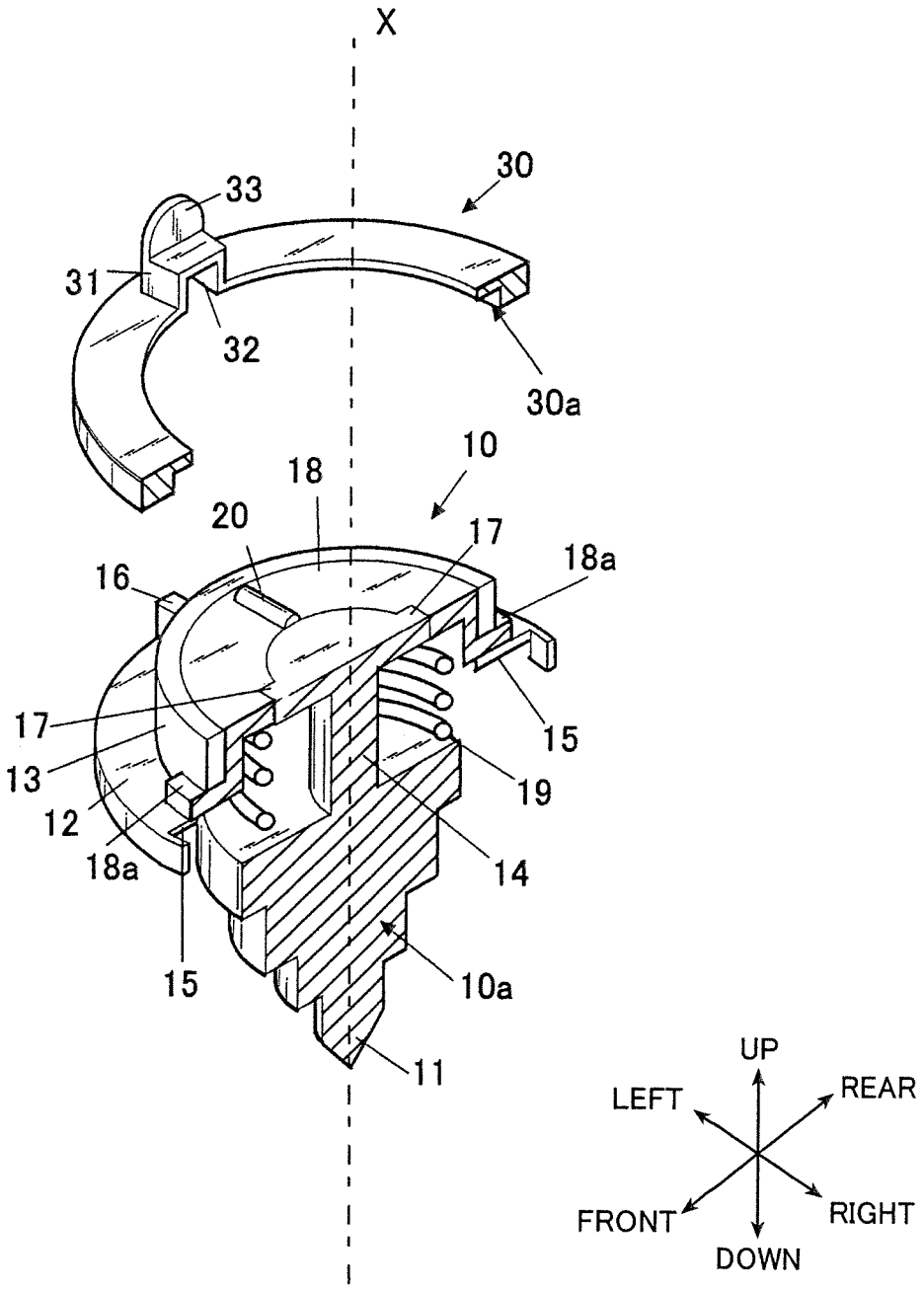
FIG. 3 is a cross-sectional perspective view of part of the toy top according to the embodiment.

FIG. 3 is a perspective cross-sectional view of the shaft portion 10 and the flywheel 30. In the shaft portion 10 and the flywheel 30, the terms up-down, right-left and front-rear represent the respective directions as illustrated in FIG. 3. The shaft portion 10 and the flywheel 30 each have a substantially symmetrical shape.

The shaft portion 10 includes a ground contact or spinning shaft 11 in the lower end section, a flange 12 in the middle section in the up-down direction, and a cylinder 13 in the upper end section.

The flange 12 is integrated with the cylinder 13. The core of the cylinder 13 includes a post 14. The upper end of the post 14 has a large diameter. This large diameter portion has two hooks 17 protruding radially outward in the front and back directions. The post 14 is fixed to a lower shaft portion 10*a*. The circumferential face of the lower shaft portion 10*a* has a diameter that decreases stepwise from the flange 12 to the tip of the spinning shaft 11, defining an inverted substantial cone as a whole. The lower shaft portion 10*a* is fixed to the flange 12 with, for example, a screw (not shown).

Two holes 15 are formed in the front and back regions across the flange 12 and the cylinder 13. The circumferential face of the cylinder 13 has two protrusions 16 in the right and left regions. The outer faces of the protrusions 16 are flush with the circumferential face of the flange 12.

The shaft portion 10 includes a cylindrical urging member 18. The urging member 18 includes an annular top panel that fits to the upper end portion of the post 14. The urging member 18 is hollow and has a downward opening. The urging member 18 fits inside the cylinder 13 and surrounds the post 14. The circumferential face at the lower end of the urging member 18 has two legs 18*a* protruding radially outward in the front and back directions.

With reference to FIG. 3, the urging member 18 is assembled such that the legs 18*a* are exposed from the respective holes 15. The holes 15 allow the respective legs 18*a* to move in the up-down direction therein. The upward movement, however, is limited by the upper edges of the holes 15. The urging member 18 is urged upward by a spring 19. In a normal state, the upper end face of the urging member 18 is substantially flush with the upper edge of the cylinder 13.

The upper face of the urging member 18 has two ridges 20 radially extending in the left and right directions.

2. Flywheel 30

The flywheel 30 has an annular shape. The inner bottom face of the flywheel 30 has an annular step 30*a* that accommodates the flange 12 of the shaft portion 10 disposed below. The upper face of the flywheel 30 has two upward protrusions 31 extending in the right and left directions. In lower parts of the protrusions 31, recesses 32 are formed so that the protrusions 16 of the shaft portion 10 can be respectively received therein. The upper face of the flywheel 30 has tongues 33 adjoining the outer faces of the protrusions 31 and extending upward. The tongues 33 protrude above the protrusions 31.

3. Body 40

Figure 4A:
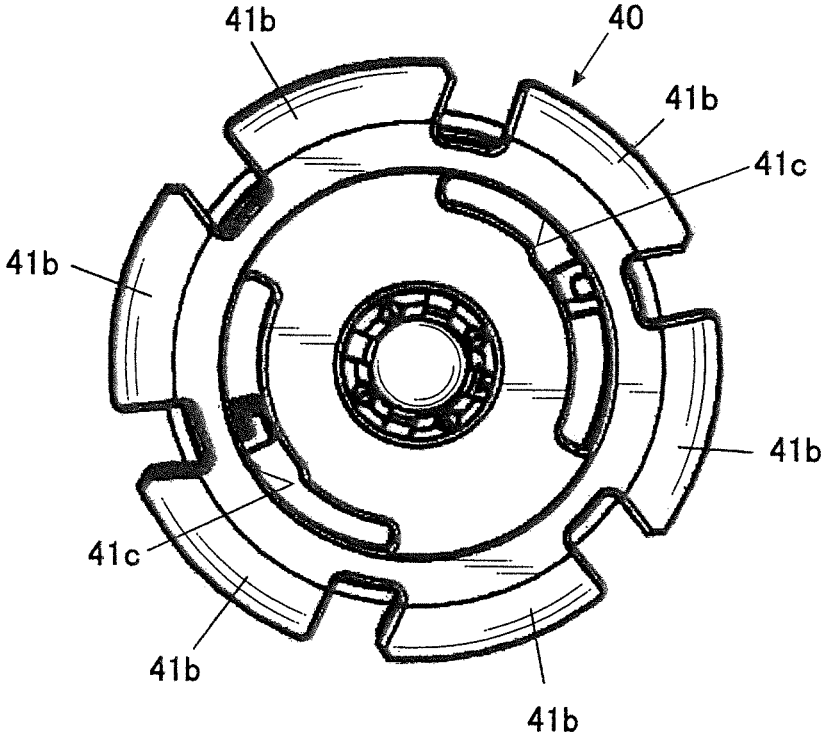
FIG. 4A is a plan view illustrating a body of the toy top according to the embodiment where second extensions are moved.
Figure 4B:
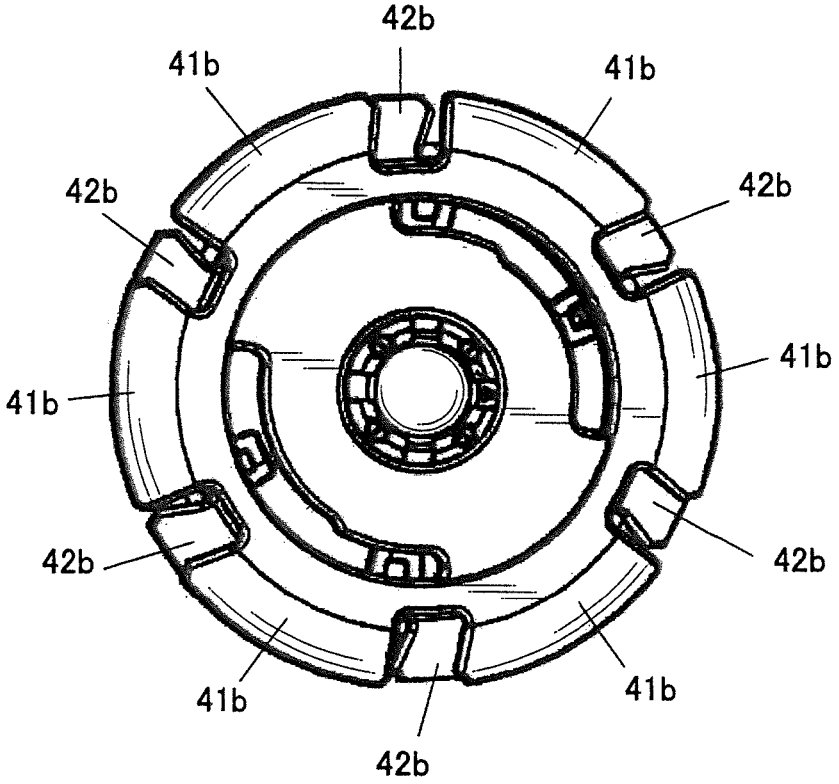
FIG. 4B is a plan view illustrating the body of the toy top according to the embodiment where the second extensions are ejected.
Figure 5:
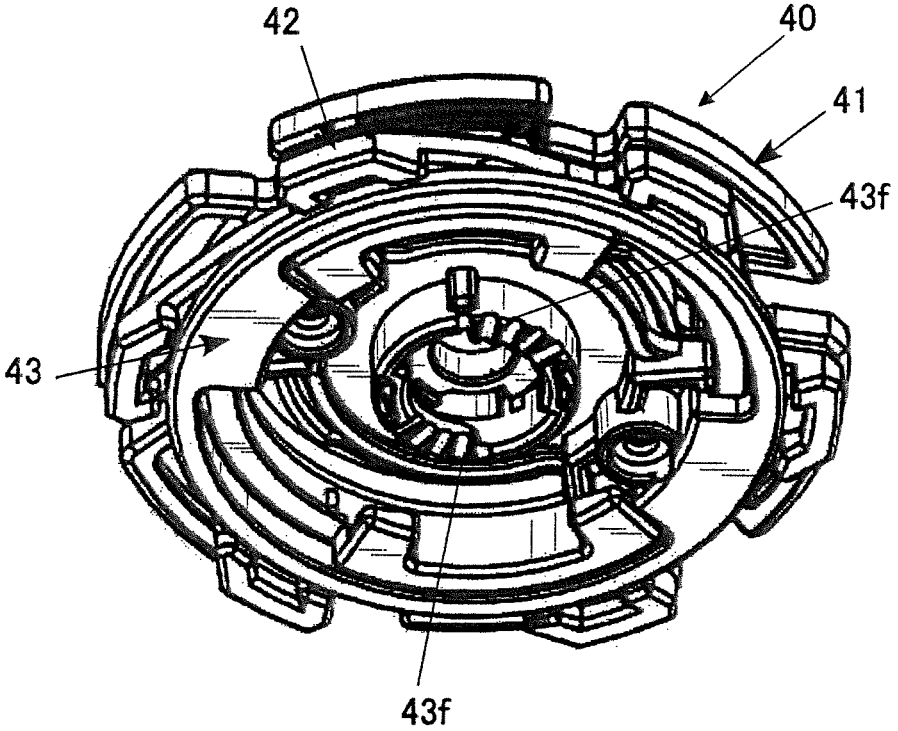
FIG. 5 is a bottom-up perspective view of the body of the toy top according to the embodiment.
Figure 6:
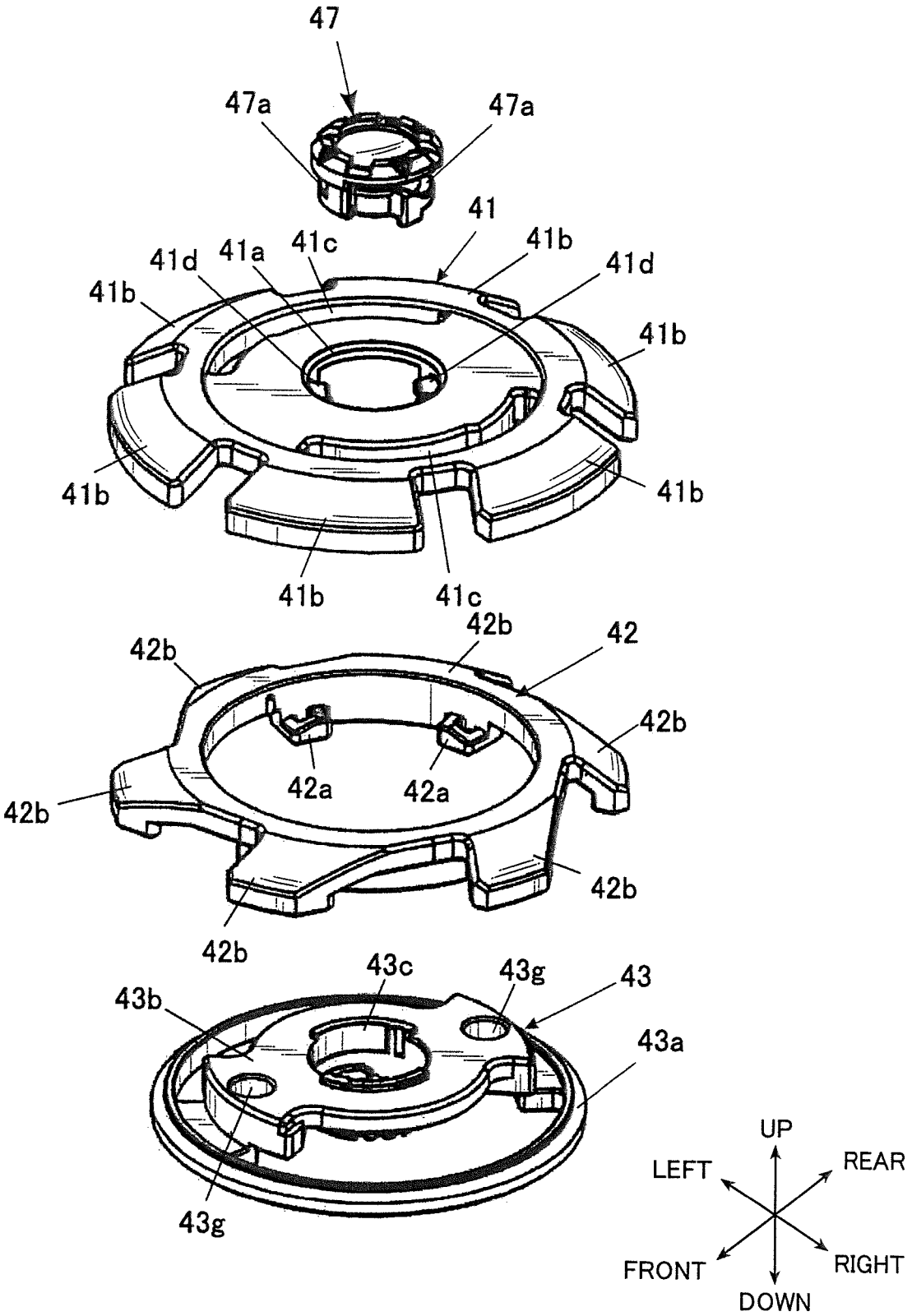
FIG. 6 is an exploded top-down perspective view of the body of the toy top according to the embodiment.
Figure 7:
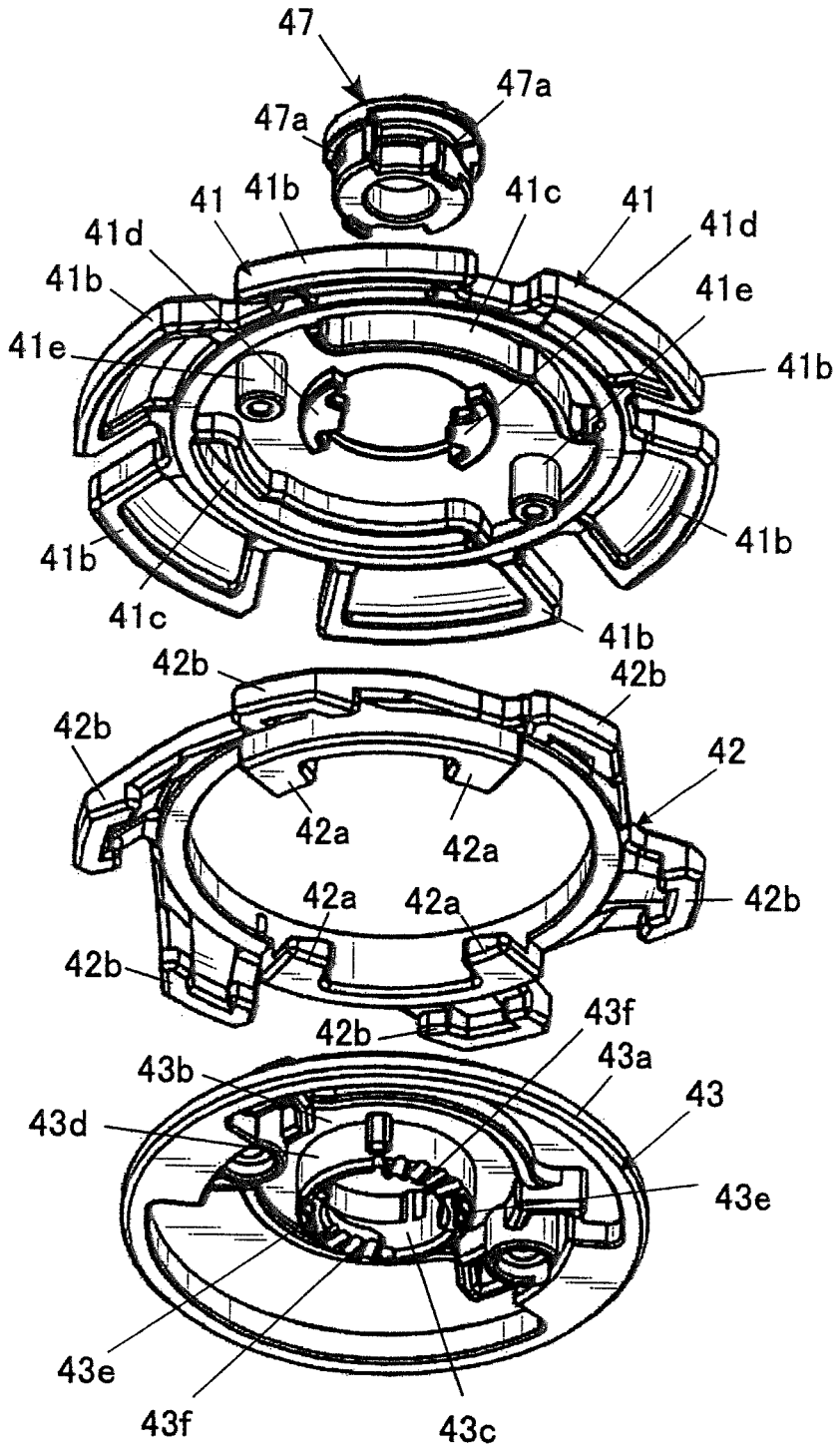
FIG. 7 is an exploded bottom-up perspective view of the body of the toy top according to the embodiment.

FIG. 4A and FIG. 4B are plan views of the body 40. FIG. 5 is a bottom perspective view of the body 40. FIG. 6 is an exploded top perspective view of the body 40. FIG. 7 is an exploded bottom perspective view of the body 40. With reference to FIGS. 6 and 7, the body 40 includes a top plate 41, a middle plate 42, and a bottom plate 43. The top plate and the bottom plate 43 are a first body part and constitute a main component. In the body 40, the terms "top," "bottom," "left," "right," "front," and "back" refer to the corresponding directions in FIG. 6.

(1) Top Plate 41

The top plate 41 has a substantially circular hole 41*a* defined in the center. The top plate 41 has six extensions 41*b* in the circumference that are disposed at equal intervals in the circumferential direction, extend radially outward, and have the same shape. In other words, the top plate 41 has six pairs of protrusions and depressions which are constituted by first extensions 41*b* and portions where extensions 41 are not formed. The extensions 41*b* may have different shapes and may be disposed at irregular intervals. Any number other than six of extensions 41*b* may be provided.

The top plate 41 also has arcuate slits 41*c* in the right and left regions. The tongues 33 of the flywheel 30 can be inserted into the arcuate slits 41*c*. The width of each arcuate slit 41*c* is large at one end and small at the other end in the circumferential direction.

The inner wall of the hole 41*a* in the top plate 41 has two projections 41*d* disposed in sites facing each other across the axis and protruding inward.

The bottom face of the top plate 41 has two cylindrical bosses 41*e* in sites facing each other across the axis. The inner walls of central holes in the bosses 41*e* have an internal thread. The bosses 41 may be disposed in other positions. The number of bosses 41 may be modified.

(2) Middle Plate 42

Figure 8:
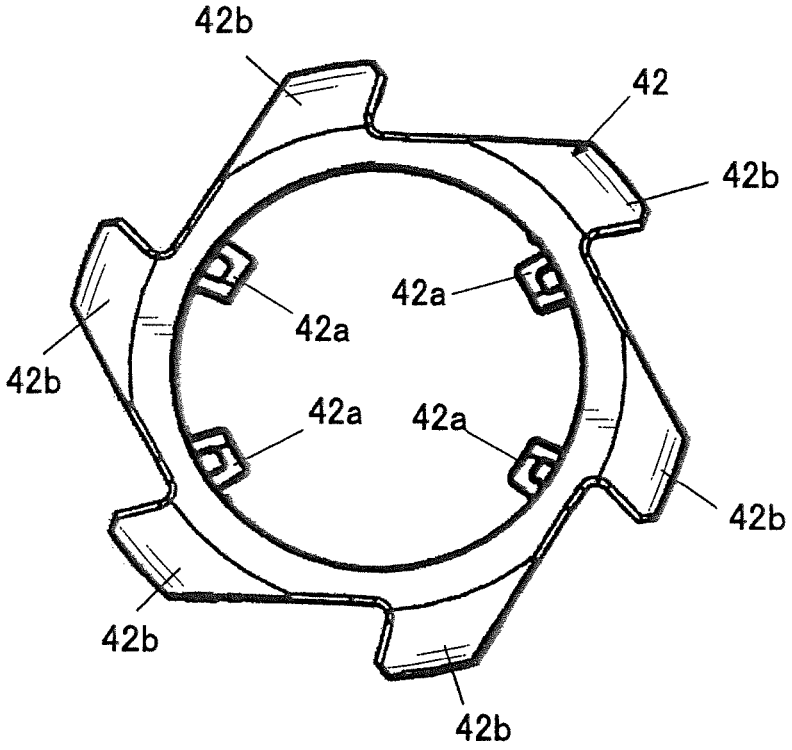
FIG. 8 is a plan view of a middle plate of the toy top according to the embodiment.
Figure 9A:
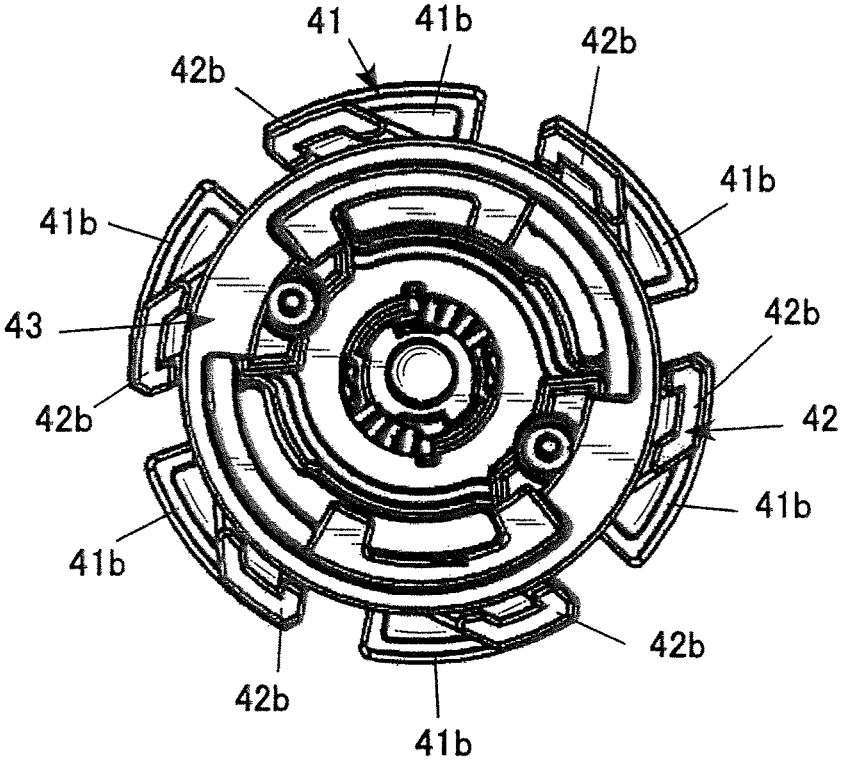
FIG. 9A is a bottom plan view explaining the operation of the toy top according to the embodiment where the second extensions are moved.
Figure 9B:
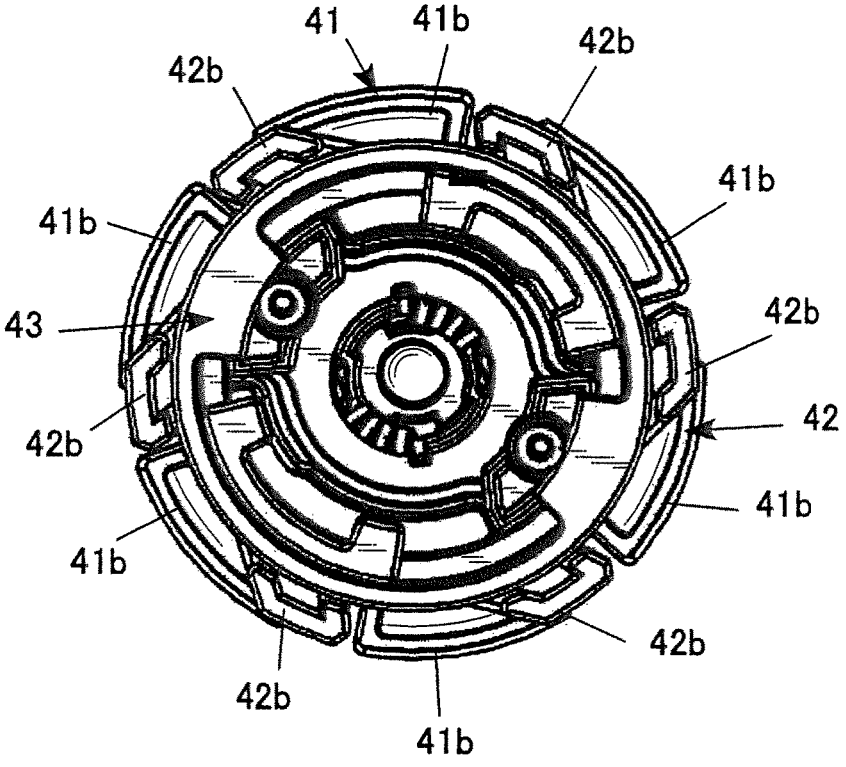
FIG. 9B is a bottom plan view explaining the operation of the toy top according to the embodiment where the second extensions are ejected.

FIG. 8 is a plan view of the middle plate 42. As illustrated in the drawing, the middle plate 42 is a second body part and has an annular shape. The inner wall of the middle plate 42 has two pairs of projections 42*a* provided in the opposite sides facing each other across the axis and protruding toward the center of the middle plate 42. The distance between each pair of projections 42*a* and 42*a* is determined such that the tongue 33 can be inserted therebetween. When the shaft portion 10 is assembled with the body 40, the projections 42*a* and 42*a* hold the tongue 33 therebetween. The relative rotation of the shaft portion 10 and thus the flywheel 30 to the top plate 41 and the bottom plate 43 causes the middle plate 42 to rotate in cooperation with the tongue 33 relative to the top plate 41 and the bottom plate 43.

The middle plate 42 also has six second extensions 42*b* in the circumference that are disposed at equal intervals in the circumferential direction and extend radially outward. In other words, the middle plate 42 has six couples of protrusions and depressions which are constituted by the extensions 42*b* and portions where the extensions 42*b* are not formed. These couples are disposed at equal intervals in the circumferential direction. The extensions 42*b* may be disposed at different intervals. Any number other than six of extensions 42*b* may be provided. Each of the extensions 42*b* has an obtuse-angled corner at the front edge in the spin direction of the toy top 1 and an acute-angled corner at the rear edge in the spin direction of the toy top 1. The extensions 42*b* each have a dimension that is covered by the extensions 41*b* in plan view. The extensions 42*b* are ejected from and moved behind the extensions 41*b* when the top plate 41 and the bottom plate 43 are rotated relative to the middle plate 42. When the extensions 42*b* are ejected from the extensions 41*b*, the extensions 42*b* fill at least portions of the depressions defined between the neighboring extensions 41*b* and 41*b* of the top plate 41 in plan view. As a result, the body 40 has a substantially circular contour.

Preferably, the extensions 42*b* do not extend more radially outward than the extensions 41*b*. If the extensions 42*b* extend more radially outward than the extensions 41*b*, the extensions 42*b* are likely to collide with an opponent toy top. If the opponent toy top spins in the same direction, the main component spins in the direction of coupling instead of decoupling relative to the shaft portion 10.

(3) Bottom Plate 43

The bottom plate 43 includes an annular frame 43*a*. The interior of the frame 43*a* is provided with a connector 43*b* supporting the frame 43*a*. The connector 43*b* has a hole 43*c* defined in the central area and having a diameter equal to that of the hole 41*a*. The connector 43*b* has two through-holes 43*g* in the front and rear. The bosses 41*e* pass through the respective through-holes 43*g*. The top plate 41 and the bottom plate 43 hold the middle plate 42 therebetween. An external thread (not shown) fed through the through-holes 43*g* from underneath is screwed with the internal thread in the bosses 41*e*, and the body 40 is thereby assembled.

The bottom face of the bottom plate 43 has an annular wall 43*d* having an inner diameter equal to the diameter of the hole 43*c*. The lower inner face of the annular wall 43*d* has two hooks 43*e* disposed opposite each other across the axis and extending inward. One end of the lower face of each hook 43*e* has an undulation 43*f* that engages with the ridge 20 of the shaft portion 10. The undulations 43*f* include several ridges in the circumferential direction.

(4) Decorative Component 47

A decorative component 47 is disposed in the hole 41*a* in the top plate 41. The decorative component 47 has a substantially circular shape and has grooves 47*a* for engagement with the projections 41*d* in the circumference. The decorative component 47 is fitted into the hole 41*a* and rotated in a predetermined direction, so that the projections 41*d* are engaged with the grooves 47*a* and the decorative component 47 is mounted to the top plate 41. The decorative component 47 is provided for distinguishing the toy top 1 from the opponent toy top. Multiple decorative components having upper faces of different colors and/or shapes may be provided.

4. Assembly of Toy Top 1

Assembly of the toy top 1 will now be described. At this point, the assembly of the shaft portion 10 and the body 40 should already be completed as illustrated in FIG. 2.

In the first stage, the protrusions 16 of the shaft portion 10 are aligned with the respective recesses 32 of the flywheel 30 from below, so as to fit the shaft portion 10 with the flywheel 30. In the second stage, this fitted body is moved close to the body 40 from below. Before this stage, the middle plate 42 should be preliminarily rotated relative to the top plate 41 and the bottom plate 43 to a predetermined position.

The tongues 33 of the flywheel 30 are then inserted to the respective arcuate slits 41*c* in the body 40 such that the tongues 33 of the flywheel 30 are disposed between the respective pairs of lugs 42*a* of the middle plate 42. In this state, the hooks 17 of the shaft portion 10 are not aligned with the hooks 43*e* of the body 40 in the up-down direction. This state is referred to as a decoupled state. The shaft portion 10 of the fitted body is then urged toward the body 40. In response, the flywheel 30 is urged to the bottom face of the body 40. The spring 19 in the shaft portion 10 then contracts, and the urging member 18 sinks. This causes the hooks 17 of the shaft portion 10 to be relatively urged above the hooks 43*e* of the body 40. The shaft portion 10 is turned together with the flywheel 30 in a predetermined direction (the direction opposite to the rotating direction of the toy top 1) relative to the top plate 41 and the bottom plate 43. This causes the hooks 43*e* of the body 40 to move beneath the hooks 17 of the shaft portion 10, such that the hooks 17 are aligned with the hooks 43*e* in the up-down direction. In response to the removal of the hand of the player from the shaft portion 10, the lower faces of the hooks 17 of the shaft portion 10 come into contact with the upper faces of the hooks 43*e* of the body 40 due to the urging force of the spring 19 inside the shaft portion 10. This state in which the lower faces of the hooks 17 of the shaft portion 10 are in contact with the upper faces of the hooks 43*e* of the body is referred to as a coupled state. As a result, the ridges 20 engage with the undulations 43*f*, and the toy top 1 is assembled. In this state in plan view, the extensions 42*b* are moved behind the extensions 41*b*, and large depressions are defined in the contour of the body 40. This facilitates the corners of the extensions 41*b* of the top plate 41 to collide with the opponent toy top and enhances the offensive strength while reducing the defensive strength.

5. How to Play

An example of how to play with the toy top 1 will now be described.

FIG. 1 is a perspective view of an exemplary launcher that rotationally drives the toy top 1.

In this example of how to play, the toy top 1 is spun to engage in a battle with an opponent toy top 1.

In such a case, the rotational force of the toy top 1 is generated with the launcher 60, such as that illustrated in FIG. 1. The launcher 60 includes an internal disk (not shown). The disk is urged in a first rotational direction by a spiral spring (not shown). A handle 61 is then pulled to pull a string (not shown) wound around the disk so as to spin the disk, thereby spinning a top holder 62. The spinning of the top holder 62 is transmitted to the toy top 1 through forks 63 protruding downward so as to spin the toy top 1. In such a case, the forks 63 are inserted into the arcuate slits 41*c* in the body 40. Fully pulling the handle 61 of the launcher 60 stops the spinning of the disk and thus the spinning of the top holder 62, but the toy top 1 continues to spin due to inertia. The toy top 1 follows tilting faces 63*a* of the fork 63 and detaches from the top holder 62.

The toy top 1 launched in this way spins in a predetermined direction in a predetermined field and collides with another toy top 1 of an opponent spinning in the same direction, for example. The impact force generated by the collision causes a reactive force to be applied to the top plate 41 and the bottom plate 43 in a direction opposite to the rotational direction of the shaft portion 10 and the flywheel 30. This causes the top plate 41 and the bottom plate 43 to spin in the opposite direction relative to the rotational direction of the shaft portion 10 and the flywheel 30.

The undulations 43*f* on the lower face of the bottom plate 43 and the ridges 20 engage each other at stepwise varying positions in cooperation with the rotation of the shaft portion 10 relative to the body 40. The middle plate rotates together with the flywheel 30 and thus rotates together with the shaft portion 10; thus, the extensions 42*b* of the middle plate 42 are ejected to or exposed in the depressions of the top plate 41. In this state, toy top 1 can parry the attack of the opponent toy top. The defensive strength is thus enhanced while the offensive strength is reduced.

Another Embodiment

In the state of the extensions 42*b* most ejected from the extensions 41*b* in the embodiment described above, the base ends of the extensions 42*b* still overlap with the extensions 41*b*. Alternatively, in the state of the extensions 42*b* most ejected from the extensions 41*b*, the extensions 42*b* may be configured to be completely ejected from the extensions 41*b* and fully fitted in the spaces (depressions) defined between the neighboring extensions 41*b* and spaces may be defined between the extensions 41*b* and the extensions 42*b* at the front edge in the spin direction of the toy top 1 and between those at the rear edge in the spin direction of the toy top 1. In this case, the ejection of the extensions 42*b* doubles the number of extensions (the number of blades). In the initial state, the extensions 42*b* may overlap with the extensions 41*b* at the rear edge in the spin direction of the toy top 1, or no space may exist between the extensions 42*b* and the extensions 41*b*.

In such a configuration of the toy top 1, the spaces are divided by the extensions 42*b* at the front edge and the extensions 42*b* at the rear edge in the spin direction of the toy top 1, such that the spaces are narrowed, which results in an increased defensive strength.

At the state of the extensions 42*b* most ejected from the extensions 41*b*, the spaces may be defined between extensions 41*b* and the extensions 42*b* at the front edge in the spin direction of the toy top 1 or between those at the rear edge in the spin direction of the toy top 1. Alternatively, at the state of the extensions 42*b* most ejected from the extensions 41*b*, the spaces between the extensions 41*b* at the front edge in the spin direction of the toy top 1 and those between the extensions 41*b* at the rear edge in the spin direction of the toy top 1 may be completely filled with the neighboring extensions 42*b*.

Alternate Embodiments of the Invention

The above embodiments should not be construed to limit the present invention and may be appropriately modified within the gist of the present invention.

For example, in the toy top 1 according to the embodiments described above, the body 40 and the shaft portion 10 are coupled by rotation of the body 40 and the shaft portion 10 in a first direction and decoupled by rotation of the body 40 and the shaft portion 10 in a second direction. The present invention may also be applied to a toy top 1 including a body 40 and a shaft portion 10 that is not decoupled by mere rotation of the body 40 and the shaft portion 10 relative to each other around an axis.

In the embodiment, as the shaft portion 10 and the body 40 move from the coupled state to the decoupled state, the extensions 42*b* are ejected. Conversely, as the shaft portion and the body 40 move from the coupled state to the decoupled state, the extensions 42*b* may be moved behind the extensions 41*b*.

Furthermore, in the embodiment, the main component (first body part) includes both the top plate 41 and the bottom plate 43. Alternatively, the main component may include either the top plate 41 or the bottom plate 43.

In the embodiment, the extensions 42*b* are provided under the extensions 41*b* formed in the main component. Conversely, the extensions 41*b* may be provided under the extensions 42*b*.

The entire disclosure of Japanese patent application No. 2017-105442, filed on May 29, 2017, is incorporated herein by reference in its entirety.

What is claimed is:

1. A toy top comprising:
a shaft portion; and
a body including a main component which is rotatable relative to the shaft portion in response to an impact applied to the main component,
wherein the body has
a first body part which constitutes the main component,
a second body part which is rotatable relative to the main component,
first spaced extensions that extend radially outward from a circumference of the first body part, and
second spaced extensions that extend radially outward from a circumference of the second body part,
wherein each of the first extensions is large enough to cover each of the second extensions in plan view,
wherein the second extensions stepwise vary their positions relative to the first extensions when the main component rotates relative to the shaft portion, and
wherein the first body part rotates relative to the second body part to switch between:
a first state in which the first extensions respectively cover the second extensions in plan view; and
a second state in which the second extensions respectively appear in the spaces between the first extensions in plan view.

2. The toy top according to claim 1, wherein the second body part vertically overlaps with the first body part and rotates together with the shaft portion.

3. The toy top according to claim 2, wherein the second body part engages with the shaft portion through an intermediary flywheel rotatable together with the shaft portion.

4. The toy top according to claim 1, wherein
the shaft portion is coupled with the body when the main component rotates in a first direction relative to the shaft portion, and
the shaft portion is decoupled from the body when the main component rotates in a second direction relative to the shaft portion.

5. A toy top comprising:
a shaft portion;

a first body part which is rotatable relative to the shaft portion in response to an impact applied to the first body part;

a second body part which is rotatable relative to the first body part;

first extensions that extend radially outward from the first body part, wherein the first extensions are separated from each other by first spaces; and second extensions that extend radially outward from the second body part, wherein the second extensions are separated from each other by second spaces, wherein each of the first extensions is large enough to cover each of the second extensions in plan view, and wherein the second body part rotates relative to the first body part, to switch between:

a first state in which the first extensions respectively cover the second extensions in plan view; and a second state in which the second extensions respectively cover the first spaces in plan view.

6. The toy top according to claim 5, wherein the second body part rotates together with the shaft portion.

7. The toy top according to claim 6, wherein the second body part engages the shaft portion through an intermediary flywheel rotatable together with the shaft portion.

8. The toy top according to claim 7, wherein the first body part is a top plate spaced from a bottom plate, in between which the second body part rotates.

9. The toy top according to claim 8, wherein the top plate includes a plurality of slits and the flywheel includes a corresponding number of projections, wherein the projections are movably received within the slits, respectively.

10. The toy top according to claim 5, wherein the shaft portion is coupled with the first body part when the first body part is rotated in a first direction relative to the shaft portion, and the shaft portion is decoupled from the first body part when the first body part is rotated in a second direction relative to the shaft portion.

11. The toy top according to claim 5, wherein the number of each of the first and second extensions is six.

12. The toy top according to claim 5, wherein the first extensions are equally spaced from each other by a first distance and the second extensions are equally spaced from each other by the first distance.

13. The toy top according to claim 5, wherein the first extensions are spaced from each other at different intervals, and the second extensions are spaced from each other at the different intervals.

14. The toy top according to claim 5, wherein an area of each of the first extensions is greater than an area of each of the second extensions.

15. The toy top according to claim 5, wherein an area of each of the first extensions is the same as an area of each of the second extensions.

16. The toy top according to claim 5, wherein an area of each of the second extensions is larger than an area of each of the first spaces between the first extensions.

17. The toy top according to claim 5, wherein when the second extensions move into the first spaces between the first extensions, an outer perimeter of the toy top is substantially circular.

18. The toy top according to claim 5, wherein the first and second extensions extend equally from the respective first and second body parts an equal distance.

19. The toy top according to claim 5, wherein the second extensions stepwise vary their positions when one of ridges and undulations formed on the second body part are moved relative to the other of ridges and undulations formed on the support shaft.

20. A toy top having an axis of rotation and comprising:

a shaft portion;

a first body part which is rotatable relative to the shaft portion in response to an impact applied to the first body part, a second body part which is rotatable relative to the first body part;

a first extension that extends radially outward from the first body part, a second extension that extends radially outward from the second body part, below the first extension relative to the axis, wherein, the second extension rotates relative to the axis between a first position that is radially the same as the first extension and a second position that is radially spaced from the first extension, wherein the second body part rotates with the shaft portion, wherein the first body part is a top plate spaced from a bottom plate, in between which the second body part rotates, and wherein the second body part engages with the shaft portion through a flywheel rotatable with the shaft portion.

* * * * *